US005699642A

United States Patent [19]

McDevitt, Jr.

[11] Patent Number: 5,699,642

[45] Date of Patent: Dec. 23, 1997

[54] PLASTIC REBAR HARNESS

[76] Inventor: Charles Joseph McDevitt, Jr., 5345 S. Macadam St., Tucson, Ariz. 85746

[21] Appl. No.: 658,722

[22] Filed: Jun. 5, 1996

[51] Int. Cl.[6] ..... E04C 5/16

[52] U.S. Cl. ..... 52/719; 52/685; 52/686; 403/389; 403/392; 403/400; 24/16 PB

[58] Field of Search ..... 52/686, 685, 719; 403/389, 392, 397, 400; 24/336, 339, 16 PB

[56] References Cited

U.S. PATENT DOCUMENTS

| | | | |
|---|---|---|---|
| 1,890,757 | 12/1932 | Strickler | 52/719 |
| 3,353,774 | 11/1967 | Thomas | 403/392 X |
| 3,981,048 | 9/1976 | Moody et al. | 24/16 PB |
| 4,132,045 | 1/1979 | Sullivan | 52/686 |
| 4,388,791 | 6/1983 | Anderson | 52/686 |
| 4,610,122 | 9/1986 | DeClercq | 52/686 |
| 4,910,831 | 3/1990 | Bingold | 24/16 PB |
| 4,936,062 | 6/1990 | Golston et al. | 52/712 |
| 5,088,158 | 2/1992 | Burkholder | 24/16 PB |
| 5,159,728 | 11/1992 | Bingold | 24/16 PB |
| 5,371,991 | 12/1994 | Bechtel et al. | 52/686 |
| 5,395,018 | 3/1995 | Studdiford | 403/400 X |

FOREIGN PATENT DOCUMENTS

| | | | |
|---|---|---|---|
| 864348 | 4/1961 | United Kingdom | 24/16 PB |

*Primary Examiner*—Carl D. Friedman
*Assistant Examiner*—Aimee E. McTigue
*Attorney, Agent, or Firm*—Patent & Trademark Services; Joseph H. McGlynn; Thomas Zack

[57] ABSTRACT

A harness system used with steel reinforcement bars or rods to hold them at a desired orientation during and after concrete is poured. The system has two substantially identical harnesses each with its own strap section and a one direction end clasp. A common spacer joins the harnesses together and orients them with respect to each other in different directions. Preferably, the harnesses and spacer are made of a moisture proof plastic material. Two steel reinforcement bars may be oriented in a desired direction—it could be parallel or at right angles to each other—and an appropriate harness system used to hold them in place as concrete is poured over them. One strap of one harness goes around a bar and is put in through its clasp end to a tightened position to hold the bar.

1 Claim, 1 Drawing Sheet

PLASTIC REBAR HARNESS

BACKGROUND OF THE INVENTION

The present invention relates to a harness system used to join reinforced iron bars or forms before concrete is poured. Presently, steel reinforcing bars used to support concrete structures are joined together by metal wire ties in a very time consuming manner. When intersecting bars are joined by such ties, their intersection creates a transition point for rust to travel from one bar to the other. The present invention reduces the time consuming tying together of the steel reinforcing bars by using an adjustable harness system and it also eliminates the rust transition point.

DESCRIPTION OF THE PRIOR ART

In the prior art various types of rod holders for steel reinforcing rods are disclosed which hold the rods prior to the pouring of concrete on them to form completed concrete structure. One example is found in the U.S. Pat. No. 4,610,122 to M. DeClercq wherein a pair of contacting reinforcing rods are held together by a hollow open-sided section. In other inventions, joining steel rods may be spaced above the ground and oriented at right angles to each other (see U.S. Pat. No. 5,371,991 to Bechtel et al.) or attached to a cross bar parallel to the steel bars (U.S. Pat. No. 4,132,045 to R. Sullivan). My invention improves on these holding, spacing and orienting inventions for steel reinforcing bars by providing for their tightening in either parallel or right angled orientations with a universally adjustable harness system.

SUMMARY OF THE INVENTION

The present invention consists of steel reinforcing bar harness system used to space, tighten and hold the bars before they are imbedded in poured concrete. The plastic harness system is made up of two substantially identical harnesses each having a strap, a one directional end clasp and a common spacer element joining the harnesses together. In one embodiment used with bars disposed at right angles with respect to each other, the system's spacer joins the harnesses in a back to back relation with a 90 degree angle between them. In another embodiment, used for parallel bars, spacer joins the harnesses together in the same plane to space and the hold bars in a parallel direction.

It is an object of the present invention to provide an improved steel reinforcing bar spacer and holder.

It is a further object of the present invention to provide holders for steel reinforcing bars oriented either parallel to each other or a right angles to each other.

It is another object of the present invention to provide a holder for such bars which has a universal applicability and is not subject to rust.

These and other objects and advantages of the present invention will be fully apparent from the following description, when taken in connection with the annexed drawings.

DESCRIPTION OF THE PREFERRED EMBODIMENT

Figure 1:
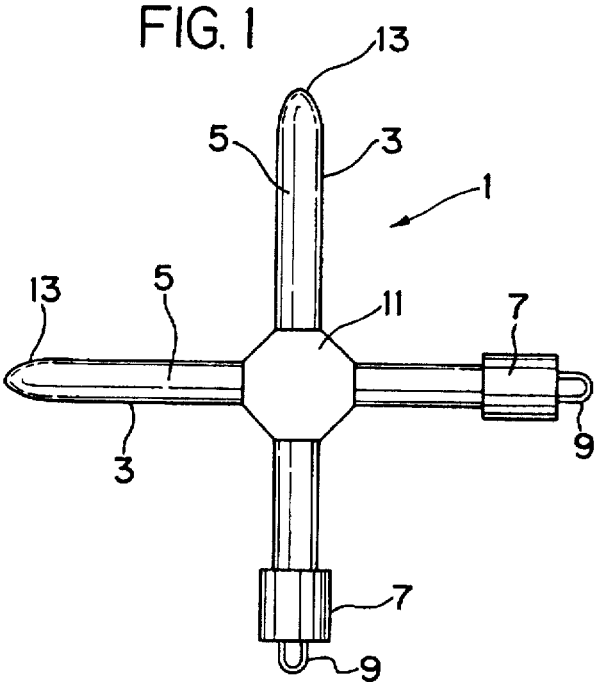
FIG. 1 is a top view of one embodiment of the present invention used to orient steel bars at right angles to each other.

Referring now to the drawings in greater detail, FIG. 1 shows a reinforcing bar (bar or re-bar) harness system 1 from a top view. The system has two substantially identical elongated flexible plastic harnesses 3 joined together back to back at right angles to each other. Each harness is easily bent to allow it to encircle a re-bar. A straight cable tie strap section 5 forms the harness's major length and has a one direction end clasp 7 with a plastic tear away hook 9. The hook is usually disposed of before using the harness. A common moisture proof plastic spacer element 11 joins the two harnesses together at rights angles with respect to each other. The one direction end clasp acts to receive the strap's other pointed free end 13 and allows it to be pulled through it but prevents its withdrawal in the opposite direction. When the strap is pulled through the clasp the harness is formed in a closed loop configuration. Each harness is looped and then tightened around a separate re-bar. In doing so, their one direction end clasps allows the straps free end to pass but prevents the tightened harness straps from becoming loose. Since the strap's length can vary greatly to accommodate many different diameter and shaped re-bars, this loop configuration gives the harness system a universal applicability.

Figure 2:
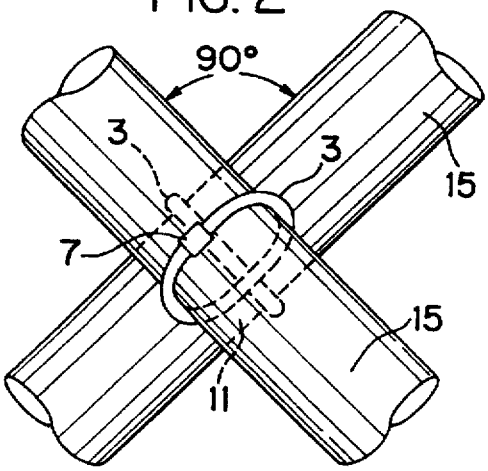
FIG. 2 illustrates the FIG. 1 harnesses used to hold two reinforcing bars at right angles to each other.

As best shown in FIG. 2, when using the FIG. 1 embodiment, the two harnesses are placed between two intersecting reinforced steel bars 15. Prior to this the bars were visually aligned at right angles to each other. A strap from each harness is looped around a re-bar and its end inserted into its one direction end clasp to extend through it. By pulling the strap near its extended free end the harness is tightened around the bar. The upper harness is partially shown in solid line format while the lower perpendicular harness is shown in dotted line format as its view is blocked by the upper re-bar. The spacer 11 both spaces the two re-bars from each other at the point of contact and orients with respect to each other.

Figure 3:
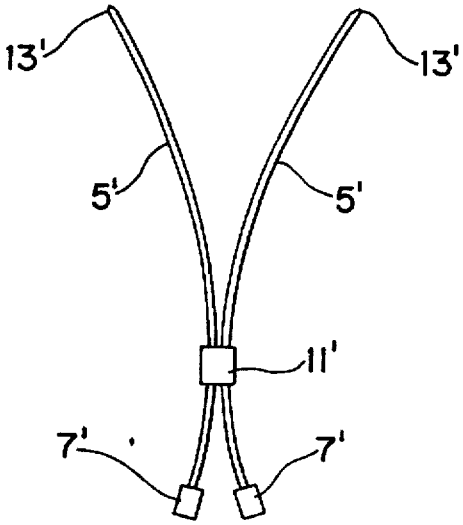
FIG. 3 is side view of another embodiment of the present invention used to orient two steel reinforcing bars in a parallel direction.
Figure 4:
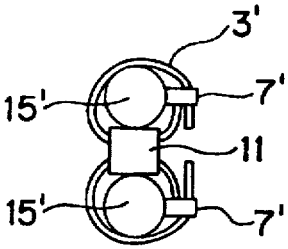
FIG. 4 is a front view showing two parallel re-bars joined together by the FIG. 3 embodiment.

FIG. 3 is a side view of an other embodiment used to hold parallel re-bars in place. It is essentially the same as the FIG. 1 embodiment except for its spacer element caused orientation. Like the FIG. 1 embodiment there are two substantially identical plastic elongated flexible harnesses 3' joined by a common plastic spacer element 11'. Here, however, the spacer orients the harnesses such that they lie in a common plane (the paper's plane). Each harness has a strap section and an end one direction clasps 7' a plastic tear away hook 9'. The other strap's end 13', its a free end, is shaped and sized to engage the clasp and be pulled through it. With two parallel re-bars are in place, the harnesses free ends 13' are looped around them, in the direction of the arrows, and their respective free ends inserted into and through their clasps 7'. The formed closed looped configuration is then tightened by pulling on the harness's strap end extending through the clasp. FIG. 4 shows a front view with the two harnesses 3' looped around two different re-bars. The harnesses are shown as configured as two circles in the same vertical plane, one over the other, separated by their common joining spacer element 11' In this figure the two parallel re-bars 15' are shown in section each held by a separate tightened harness and separated by the spacer. By changing the thickness dimensions of the spacer element, spacing between the held re-bars can vary greatly.

My invention finds application in all steel reinforced concrete pourings such as those used in the construction of bridges, walls, pools, and structural footings when bar ties or harnesses are left in place with the bars. It allows a quick and convenient setup of the bars in a manner which eliminates the creation of a transition point for rust by using moisture proof plastic spacers between the bars. Since the harness is universal and easily adjusted, it can be used on a great variety of different sized reinforcement bars. For re-bars oriented in a parallel direction, their overall length would determine the number of spaced harnesses systems to be used. It is contemplated that when re-bars are to be joined at right angles, one of the FIG. 1 embodiment harness systems would be used at each such intersection. Orientations other than right angles or parallel are also possible by changing the spacer and harnesses orientation with respect to each other. The plastic material used for all system elements is inexpensive to produce making it cost comparable to the tie wires commonly used today.

Other variables may also dictate the specific harness characteristics. For example, the plastic material used in their construction must be sufficient strong enough not to break under the weight imposed by the poured concrete or, if workman are to walk on the poured concrete, provide for this. Envisioned are a great vary of harness systems with different lengths, sizes and strengths depending upon the contemplated use.

Although the PLASTIC REBAR HARNESS and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The combination of a harness system and steel reinforcement bars comprising:

two steel reinforcement bars oriented at a desired angle with respect to each other;

two interconnected flexible harnesses each with a one direction clasp at one end and a free end at the other end;

each of said harnesses having a strap section between its free end and clasp, each of said harness's straps and free ends being capable of engaging their respective one direction clasps to form a closed looped configuration around each of said steel reinforcement bars; and a common moisture proof spacer element for interconnecting together and orienting each of said harnesses between their free ends and clasps;

said spacer being located between said two steel reinforcement bars and oriented at a desired angle to space the bars apart and hold them in the desired angular orientation when said harnesses are looped around the bars with their free ends extending through the one direction claps and pulled to tighten the harnesses around the bars; and wherein said steel reinforcement bars are oriented at approximately right angles with respect to each other and held at this orientation by the spacer and tightened harnesses.

* * * * *